United States Patent [19]

Thielen

[11] 4,138,804

[45] Feb. 13, 1979

[54] MACHINE HEAD ASSEMBLY AND TORQUE-TRANSMITTING DEVICE INCORPORATED IN THE SAME

[75] Inventor: James E. Thielen, New Brighton, Minn.

[73] Assignee: Minnesota Mining and Manufacturing Company, St. Paul, Minn.

[21] Appl. No.: 739,150

[22] Filed: Nov. 5, 1976

[51] Int. Cl.[2] ..... B24D 17/00; B24B 23/00

[52] U.S. Cl. ..... 51/168; 51/177; 51/358; 15/230.17; 64/13

[58] Field of Search ..... 51/168, 177, 376, 379, 51/358, 378; 15/230.17; 64/13

[56] References Cited

U.S. PATENT DOCUMENTS

| | | | |
|---|---|---|---|
| 1,777,915 | 10/1930 | Douglas | 15/230.17 |
| 2,114,967 | 4/1938 | Myers | 51/379 |
| 2,767,527 | 10/1956 | Tocci-Guilbert | 51/168 |
| 2,882,652 | 4/1959 | Owen | 51/168 |
| 2,950,583 | 8/1960 | Nilsson | 51/177 |
| 2,950,584 | 8/1960 | Welch | 51/378 |
| 3,315,420 | 4/1967 | Moberg | 51/378 |
| 3,527,001 | 9/1970 | Kleemeier | 15/230.17 |
| 3,707,059 | 12/1972 | Burtch | 51/358 |

FOREIGN PATENT DOCUMENTS 404533 10/1969 Australia.

*Primary Examiner*—Harold D. Whitehead
*Assistant Examiner*—Roscoe V. Parker
*Attorney, Agent, or Firm*—Cruzan Alexander; Donald M. Sell; Richard Francis

[57] ABSTRACT

A machine head assembly of the type utilized with rotary floor surface treating machines comprises means for connecting the machine head assembly to the machine's drive shaft connected to a novel flexible annular torque-transmitting member which is connected to a means for engaging a floor surface treating article such as a brush or floor polishing or treating pad. The novel flexible torque-transmitting member comprises a hollow open-ended body having an internal ring at its top end for attachment with the drive shaft connecting means and an external flange at its bottom end for attachment with the means for engaging a floor surface treating article. The interior of the torque-transmitting member has a multiplicity of spaced ribs having their bottom edges disposed approximately in the plane defined by the bottom surface of the external flange.

7 Claims, 3 Drawing Figures

MACHINE HEAD ASSEMBLY AND TORQUE-TRANSMITTING DEVICE INCORPORATED IN THE SAME

BACKGROUND OF THE INVENTION

1. Field of the Invention

This invention relates to machine head assemblies for floor care machines and to a novel torque-transmitting member for use in such machines.

2. Prior Art

Recent developments in floor polishing and scrubbing machines has produced a so-called high-speed floor polishing/scrubbing machine which has been found to clean and polish floors much faster and more efficiently than the conventional lower speed machine. The high speed machines operate at about 350 revolutions per minute as compared to half this amount for the more conventional machines. It has been found that, unfortunately, the higher speed machines are much more difficult to control, thus leading to premature operator fatigue. This control difficulty is thought to be produced by floor discontinuities and for other reasons which cause stress at the machine head which is transmitted to the machine's handle.

Various flexible torque-transmitting devices have been proposed for incorporating into such machines to inhibit such stress transfer but these have generally been found to be ineffective. The simplest and most common torque-transmitting member is a flexible annulus, looking much like a very large washer, which is fastened within the machine head assembly. Such a device has been found to be too expensive to use because it requires a complex fastening arrangement, having many parts.

BRIEF SUMMARY OF THE INVENTION

The present invention provides a flexible torque-transmitting member for a machine which avoids the problem mentioned above. The torque-transmitting member is sufficiently flexible to substantially reduce all transmission of stress to the machine handle yet it is sufficiently strong to have a long useful life. The torque-transmitting member of the invention has a unique shape which permits it to be installed directly between the drive shaft connecting means and the floor surface-treating engaging means, without requiring additional installation parts such as are required for the installation of the annulus-shaped member of the prior art.

The machine head assembly of the present invention comprises a means for connecting the machine head to the drive shaft in mechanical engagement with a novel flexible torque-transmitting member which is connected to a means for engaging a floor surface treating article such as a brush or floor polishing or treating pad. The novel flexible annular torque-transmitting member comprises a hollow open-ended body having an integral internal ring at its top end for attachment with the drive shaft connecting means and an external flange at its bottom end for attachment with the means for engaging a floor surface treating article. The interior of the torque-transmitting member has a multiplicity of spaced ribs depending from and integral with an inner surface of the body. The bottom edges of the ribs are located approximately in the plane defined by the bottom surface of the external flange.

BRIEF DESCRIPTION OF THE DRAWING

A further understanding of the invention can be had by referring to the accompanying specification and drawing wherein.

DETAILED DESCRIPTION OF THE PREFERRED EMBODIMENTS

Figure 1:
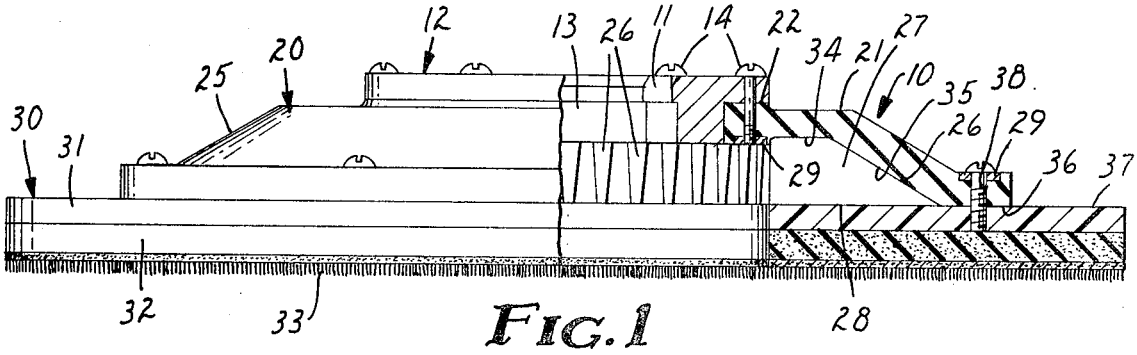
FIG. 1 is a side view in partial section of one embodiment of the machine head assembly of the invention.
Figure 2:
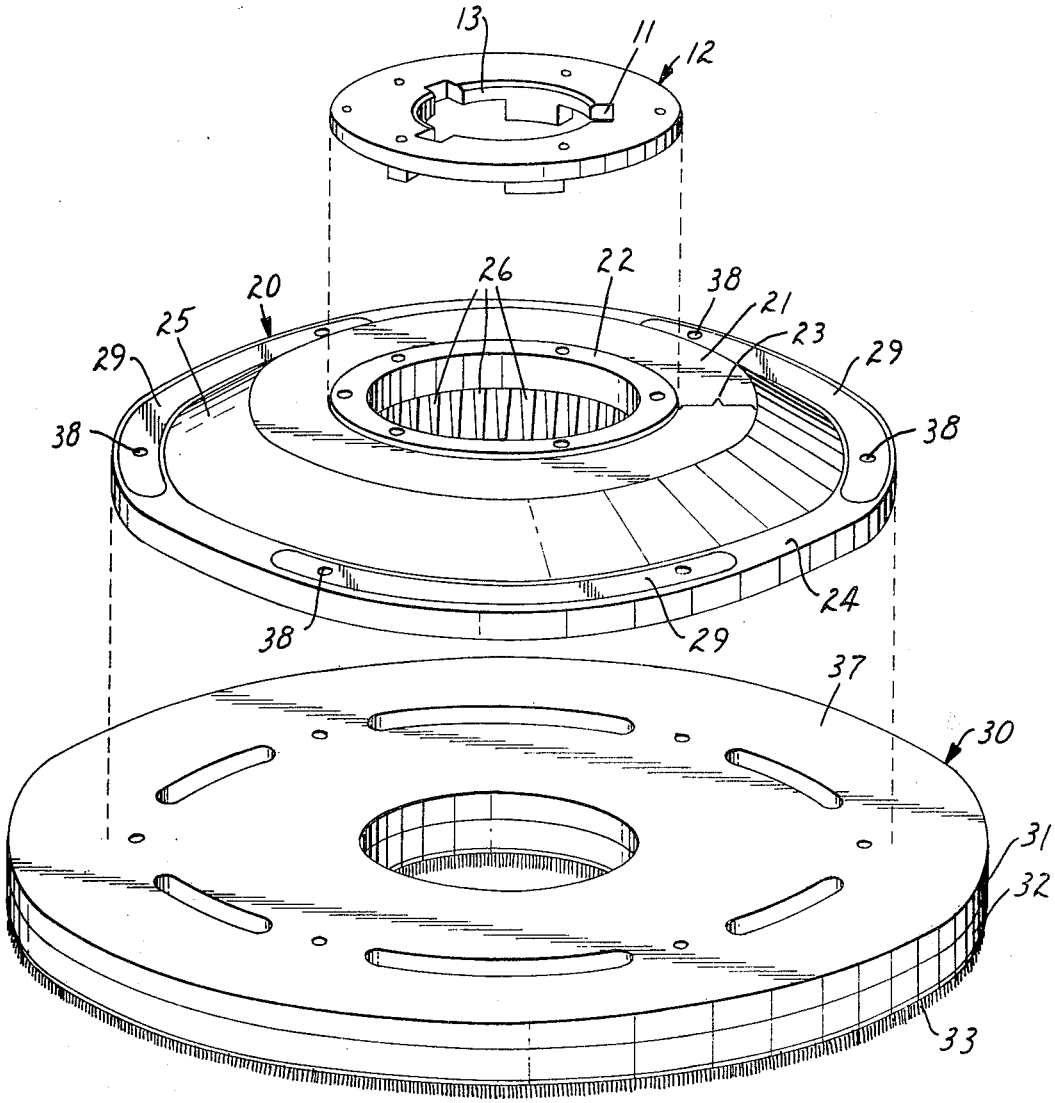
FIG. 2 is an exploded view of the assembly of FIG. 1, omitting the attachment screws.
Figure 3:
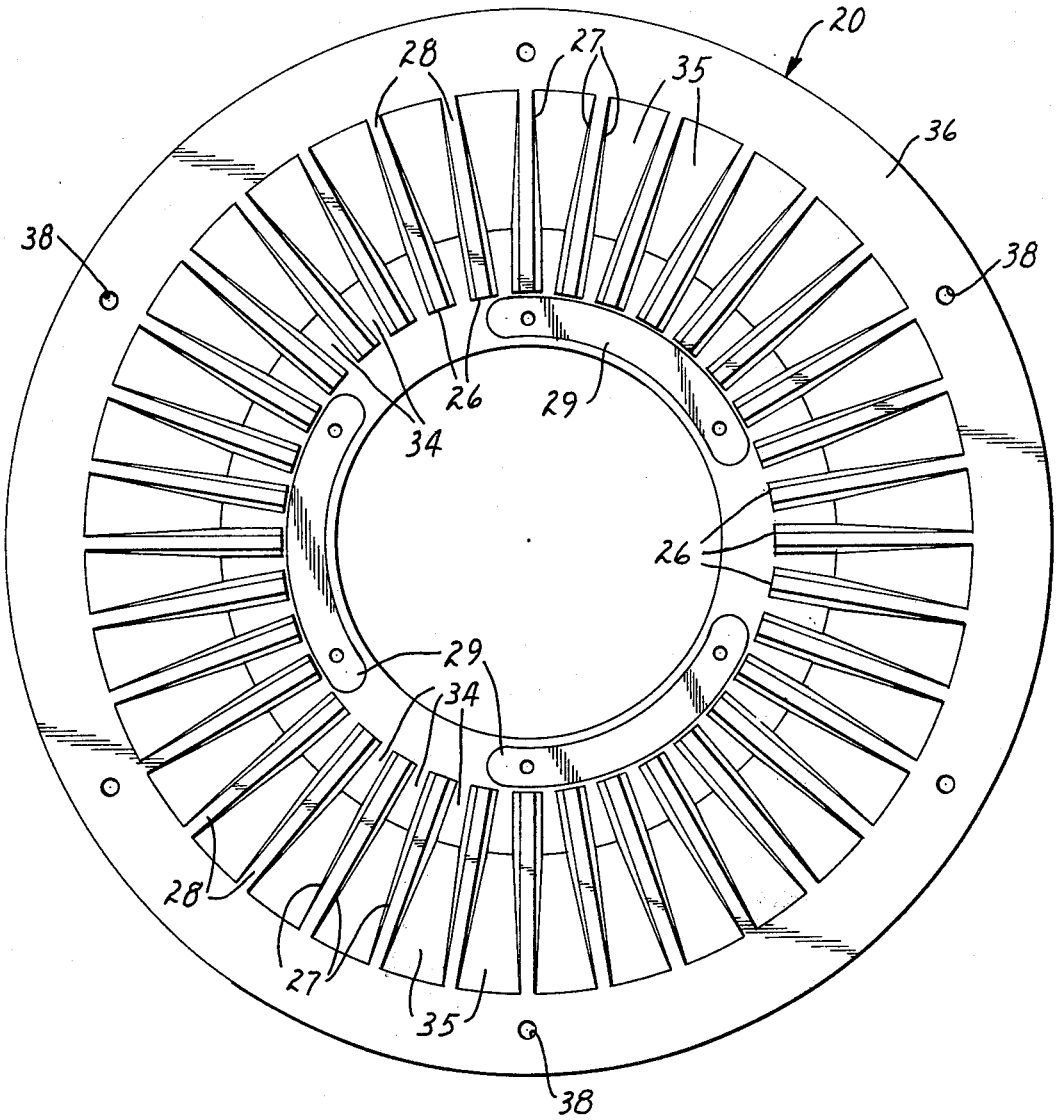
FIG. 3 is a bottom plan view of one embodiment of the torque-transmitting member of the invention.

Referring to the accompanying drawing in which like numerals refer to like parts, FIG. 1 shows the connected components of the machine head assembly 10 of the invention. FIG. 2 shows an exploded view of the components forming machine head assembly 10. These components include attachment means 12 having an engagement means such as a central opening 13 and recesses 11 capable of accommodating the engagement portion sometimes called the drive hub (not shown) of the drive shaft of a conventional floor polishing machine (also not shown). Such attachment means are well known and are appropriately shaped to accommodate any of a variety of mechanisms which may be present at the engagement portion of the drive shaft connecting means. Attachment means 12 is fastened by any suitable means, for example, machine screws 14 to flexible annular torque-transmitting member 20.

Flexible annular torque-transmitting member 20 has an open-ended body 25, preferably truncated conical as shown, having an internal ring 21 located at its top end and axially spaced therefrom an external flange 24 located at the bottom end. The interior of the body 25 of torque-transmitting member 20 has integral spaced support ribs 26 which are preferably uniformly spaced and radially aligned as shown.

Internal ring 21 has an inner attachment portion 22 adapted to engage a surface of attachment means 12. Ribs 26 depend from the inner surface 34 of ring 21, with the ends of ribs 26 extending to and being integral with the inner surface 35 of body 25. The bottom edges 28 of ribs 26 are disposed approximately in the plane defined by the bottom surface 36 of external flange 24. External flange surface 36 is adapted to engage a surface 37 of a rotatable means 30 for engaging a floor treating article such as a brush or floor finishing or treating pad. The preferred rotatable means 30 for such engagement, as shown, is provided by rigid base 31 having resilient layer 32 bearing a multiplicity of closely spaced erect filament segments 33 capable of engaging a floor treating pad, for example, a low density abrasive pad, of the type disclosed by Hoover et al in U.S. Pat. No. 2,958,593; Kleemeier et al disclose this type of engaging means in U.S. Pat. No. 3,527,001, the disclosure of which is incorporated by reference for its teaching of this aspect of the device of the invention.

The inner attachment ring 22 and flange 24 of flexible torque-transmitting member 20 of the invention may be reinforced by rigid reinforcing members 29. Reinforcing members may be either as a ring-like member embedded within each the ring and the flange or may be portions thereof, as shown, preferably having attachment holes 38 therethrough near the ends of each reinforcing member 29. Such reinforcing members may be made of metal such as steel or of a rigid plastic such as nylon.

Torque-transmitting member 20 is formed of a relatively firm flexible material such as natural rubber or urethane rubber. The material forming the torque-transmitting member should be resistant to cleaning solutions normally encountered in cleaning floors or be resistant to the particular environment of use, if a use other than floor cleaning use is contemplated. By flexible and firm is meant the material forming the torque-transmitting member should have a Shore A durometer hardness value of from about 50 to about 90, preferably about 65 to about 75. Materials having a Shore A durometer of less than about 55, although they may be useful for normal treatment, will be too soft to permit "heeling" of a machine to remove particularly difficult stains from the floor. Heeling involves twisting and forcing the handle down to permit an edge of the working face of the pad or brush to bear down on a small area, lifting the remaining portion of the working face of the machine off the floor. This causes the full weight of the machine to be directed upon the small area.

The support ribs 26 are shown in the preferred embodiment as being uniformly spaced and radially aligned but these may take other configurations which will provide the necessary support and flexing. For example, the support ribs may be as continuous ring-like structures in a concentric arrangement. The ribs may be tapered as shown or they may have straight walls.

Support ribs 26 should be sufficiently narrow to permit easy flexing since it is their function in the torque-transmitting member to provide damped transmission of varying stresses to the handle of the machine. Such gradual transmission of damped stresses results from this flexing. Preferably, the support ribs should be on the order of ⅛ inch to 1 inch wide at their bottom edges, most preferably not greater than ½ inch wide.

The entire structure of the torque-transmitting member should be such that it will support the weight of a conventional floor treating machine without deforming the structure or collapsing it. Such deformation could cause the machine skirt to contact the floor.

What is claimed is:

1. A machine head assembly especially useful with a rotary floor surface treating machine, comprising, in combination:

attachment means for connecting said assembly to the drive shaft of a floor surface treating machine;

firmly attached to said attachment means, a relatively firm, flexible annular torque-transmitting member comprising a hollow open-ended body having an inner ring at its top end having a portion thereof adapted for attachment to said attachment means, an external flange axially spaced from said ring at its bottom end, and a multiplicity of spaced flexible support ribs each depending from and integral with the inner surface of said ring, with the bottom edges of said ribs being located approximately in the plane defined by the bottom surface of said external flange, the material forming relatively firm, said flexible torque-transmitting member have a Shore A durometer hardness from about 50 to about 90; and firmly attached to said bottom surface of said external flange of said torque-transmitting member, rotatable means for engaging a floor surface treating article.

2. The machine head of claim 1 wherein said ribs of said torque-transmitting member are uniformly spaced and radially aligned.

3. The assembly of claim 1 wherein said rotatable means for engaging a floor surface treating article has a base member having a surface for attachment to the bottom surface of the external flange of said torque-transmitting member and said means for engaging is a multiplicity of erect stiff synthetic filament segments affixed to the opposite surface of the base member to permit gripping of low-density abrasive pads.

4. An annular torque-transmitting member, comprising:

a hollow open-ended relatively firm, flexible body having an inner ring at its top end, an external flange axially spaced from said ring at its bottom end, and a multiplicity of spaced ribs each depending from and integral with the inner surface of said ring, with the bottom edges of said ribs being located in approximately the same plane defined by the bottom surface of said external flange, the material forming said torque-transmitting member having a Shore A durometer hardness from about 50 to about 90; and firmly attached to said bottom surface of said external flange of said torque-transmitting member, rotatable means for engaging a floor surface treating article.

5. The flexible annular torque-transmitting member of claim 4 wherein said ribs are uniformly spaced and radially aligned.

6. The torque-transmitting member of claim 4 further including reinforcing means to strengthen said inner ring and said flange.

7. The machine head of claim 2 wherein the body of the torque-transmitting member has a truncated conical shape.

* * * * *